US005191158A

United States Patent [19]

Fuller et al.

[11] Patent Number: 5,191,158

[45] Date of Patent: Mar. 2, 1993

[54] TRIGGER GUARD FOR A FIREARM

[76] Inventors: Ann D. Fuller; Robert M. Fuller, both of Rte. 1, Duncan Bridge Rd., Sautee, Ga. 30571

[21] Appl. No.: 848,704

[22] Filed: Mar. 9, 1992

[51] Int. Cl.[5] ..... F41A 17/54

[52] U.S. Cl. ..... 42/70.07

[58] Field of Search ..... 42/70.07, 70.06, 70.11, 42/70.01

[56] References Cited

U.S. PATENT DOCUMENTS

| | | | |
|---|---|---|---|
| 3,392,471 | 7/1968 | Foote | 42/70.07 |
| 3,956,842 | 5/1976 | Ballenger | 42/70.07 |
| 4,499,681 | 2/1985 | Bako et al. | 42/70.07 |

FOREIGN PATENT DOCUMENTS

| | | | |
|---|---|---|---|
| 138331 | 12/1952 | Sweden | 42/70.07 |
| 1290330 | 9/1972 | United Kingdom | 42/70.07 |

*Primary Examiner*—Stephen M. Johnson

*Attorney, Agent, or Firm*—Needle & Rosenberg

[57] ABSTRACT

A safety device for a firearm that prevents access to the trigger and, thus, unauthorized operation of the same. The device comprises a frame, a first element on the frame, a second element which is movable on the frame and means for securing the second element on the frame at a selected distance from the first element so as to capture therebetween and render inoperable the trigger. The securing means requires some degree of manual dexterity to operate so as to discourage a child from removing the device from the firearm.

6 Claims, 2 Drawing Sheets

TRIGGER GUARD FOR A FIREARM

BACKGROUND OF THE INVENTION

This invention relates to a safety device for a firearm and, more particularly, to a device for selectively rendering the trigger of a firearm inoperative by unauthorized individuals, particularly children.

The number of deaths of children caused by accidental shootings is alarming. Although parents often hide in the home from their children a loaded weapon, the location of the firearm often becomes known and the child is severely injured or killed playing with it. Children could be frustrated and thus discouraged from such activities if they were prevented access to the trigger.

Gun safety devices are presently available which lock the gun trigger in place, usually a locking mechanism that is operable with a key. However, such firearm safety devices do not obscure the trigger so that a child is still tempted to hold the gun in his or her hand and pretend that the gun is being fired. Such handling may lead to an accidental discharge of the weapon, injuring the handler and/or bystanders.

SUMMARY OF THE INVENTION

The disadvantages of the prior art are overcome by the present invention which provides a simple, inexpensive, lightweight device for controlling the operation of most firearms by preventing unauthorized access to the trigger, particularly by children. The device essentially provides a clamping mechanism which overlies at least the trigger, and usually the trigger guard as well, depending upon the configuration of the weapon.

The construction of the device includes a channel-shaped frame that has a pair of side walls which are interconnected along the rear edges by a back wall. A first element is fixed to the frame and extends outwardly from the bottom edges of the side walls. A second element, which is complementary in shape to the first element, is movable on the frame to assume an opposed relationship to the first element. Means are provided for securing the second element on the frame at a selected distance from the first element so as to retain and clamp therebetween at least the trigger of the weapon.

The securing means includes a pair of legs that depend from the second element and which extend into the frame between the side walls. Serrations are provided along the inner surfaces of the side walls, the serrations being complementary in shape to serrations on the outer surfaces of the legs.

The legs are flexibly mounted to the second element about a horizontal axis so that the serrations on the legs may be selectively moved in or out of engagement with the serrations on the side walls of the frame. That movement is accomplished by having a shaft, which is fixed to and laterally projecting from, the outer surface of each leg extend through a vertically elongated opening in each side wall. A head member in the form of a round button is mounted on the distal end of each shaft for partial rotation about the longitudinal axis thereof. The back surface of the head member includes a protrusion which extends towards the opening in the side wall, the protrusion having a dimension so that it may be received within the opening. When the head members are rotated about their shafts so that the protrusions are aligned with the openings in the side walls, the head members can then be pressed inwardly, causing the serrations on the legs to become disengaged from the serrations on the side walls. When the respective serrations are not in contact with each other, the second element can be moved upwardly or downwardly within the frame to either allow removal of the device from the weapon or cause the second element to coact with the first element to cover the trigger of the weapon.

The protrusion serves as a means of keeping young children from having ready access to the trigger, but allows an adult ready access to the same. This safety feature is provided by requiring some dexterity to properly align each protrusion with its respective opening, pressing both legs out of their locked position and lifting the second element out of contact with the trigger.

An object of the present invention is to provide a mechanism for covering the trigger and its associated housing of a firearm to prevent the unauthorized operation of the weapon, especially by a child.

Another object of the present invention is to prevent access to the trigger of a firearm by a safety device which does not require a key or electrical circuitry to operate.

Further objects will become evident upon a review of the following description of the invention.

DETAILED DESCRIPTION OF THE ILLUSTRATIVE EMBODIMENT

Figure 1:
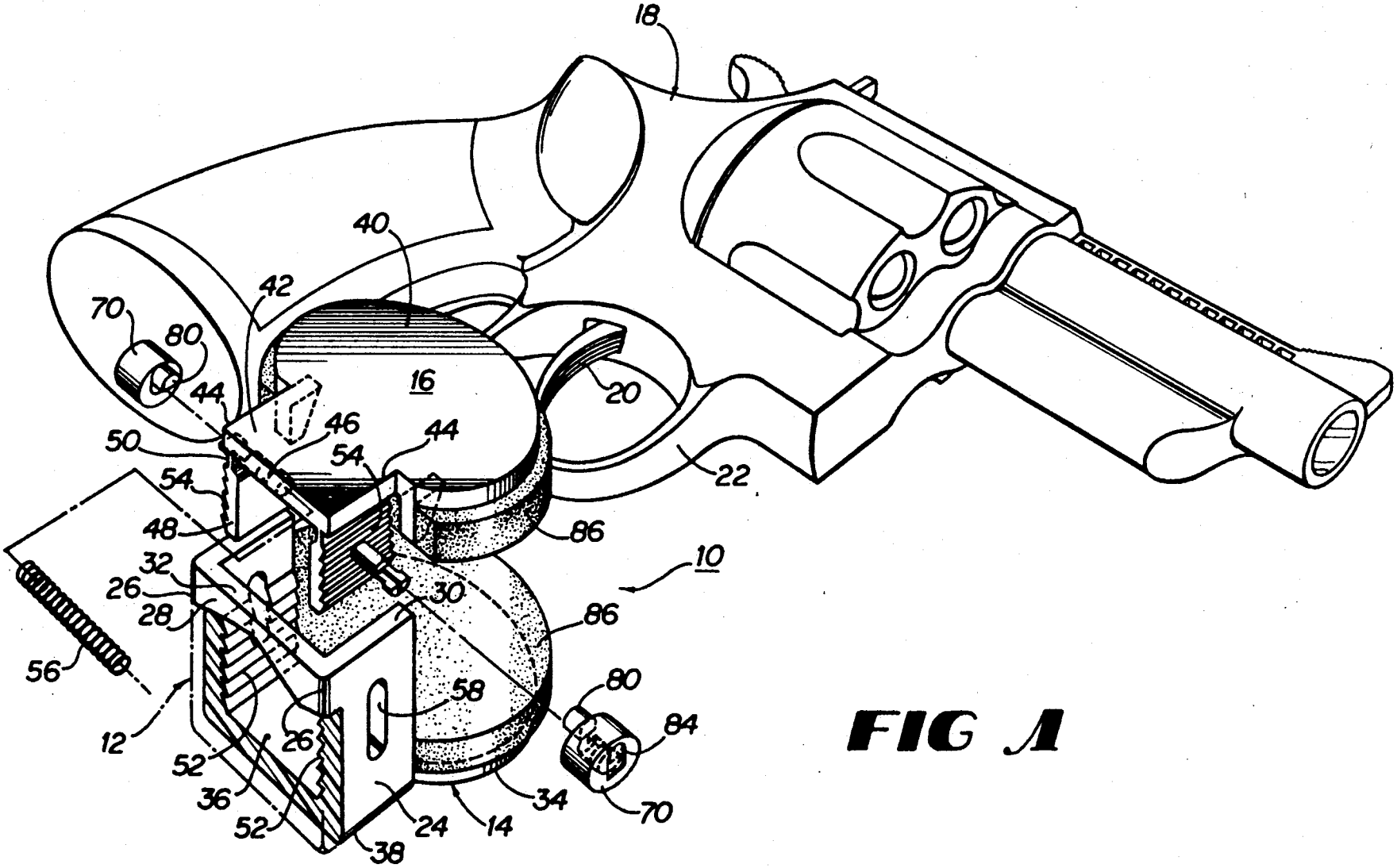
FIG. 1 is an exploded perspective view of the present invention in conjunction with a firearm with the back of the frame broken away for clarity.

With reference to the figures of the drawings, the numeral 10 denotes generally the present invention and comprises a frame 12, a first element 14 and a second element 16 in opposed relationship thereto. The device 10 is shown in use in connection with a pistol 18, but it is understood that the invention is operable with almost any firearm, including a rifle or shotgun. The pistol 18 includes a trigger 20 and a trigger guard 22.

The frame 12 and the elements 14, 16 can be constructed out of any convenient material, preferably plastic or a nylon. The frame 12 is in the shape of a channel member and includes a pair of side walls 24 which are joined along their rear edges 26 by an end wall 28. The top edges 30 of the side walls 24 are co-planar with the top 32 of the end wall 28.

The first and second elements 14, 16 are dimensioned so as to overlie on each side, and prevent access to, at least the trigger 20 when they are clamped together in their operative position. However, depending upon the configuration of the firearm, the elements 14, 16 can also be of a size to engage therebetween the trigger guard of the weapon, as shown.

The first element 14 is of a unitary construction and has a generally oval-shaped forward portion 34 and a smaller dimensioned rectangular-shaped, rearwardly extending portion 36 that forms the bottom of the frame 12 adjacent the bottom edges 38 of the side walls 24. The second element 16 has a forward portion 40 that is similar in shape to forward portion 34 and a rear portion 42 that has side edges 44 and a rear edge 46. The lateral width of the rear portion 42 is such that it is slightly less than the distance between the inner surfaces of the side walls 24 to allow the second element 14 to move vertically between the side walls 24.

A pair of legs 48 depend from the rear section adjacent the side edges 42. The legs 48 have a lateral width which is substantially similar to the width of the side walls 24. The top of the legs 48 are connected to the bottom of the rear portion 42 through a "live hinge" 50 so as to allow the legs to move about a laterally extending, horizontal axis. It is understood that any convenient means could be utilized to connect the legs 48 to the rear portion 42 so long as some flexibility is allowed in the movement of the legs 48.

A plurality of serrations 52 laterally extend in vertical alignment along a portion of the inner surface of side walls 24. Complementary-shaped serrations 54 are disposed on the outer surface of the legs 48 which, along with serrations 52, form a part of the means for securing the second element 16 on the frame 12 at a selected distance from the first element 14 so as to engage therebetween, and prevent access to, at least the trigger 20. Resilient means, in the form of spring 56 mounted on projections from the rear surfaces of the legs 48 normally biases the serrations 52, 54 into engagement with each other.

Figure 7:
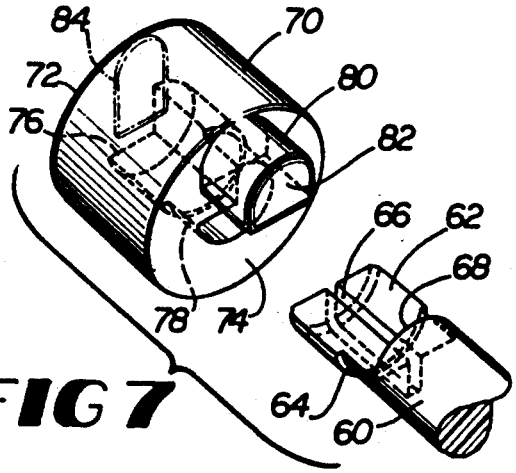
FIG. 7 is an exploded perspective view of the finger engaging means of the present invention taken at inset circle 7 in FIG. 1.

An elongated opening 58 vertically extends through each of the side walls 24. As more clearly seen in FIG. 7, a shaft 60, having a dimension to extend through the opening 58, is affixed at one of its ends to the mid-portion of the outer surface of each leg 48. A detailed view of the end or distal portion of shaft 60 is shown in FIG. 7 and includes a lug end portion 62 that is joined to the shaft 60 by a reduced diameter neck portion 64, lug 62 and neck 64 forming a half-round portion of the shaft 60. A longitudinal passageway 66 divides the half-round portion into two equal shaped halves. The half-round portion terminates in half-face 68 on shaft 60.

A finger engaging member is provided in the form of circular button 70 having a flat front surface 72 and a rear surface 74. Axially disposed within button 70 adjacent the front surface 72 is a three-quarters round cavity 76 followed by a neck recess 78. The cavity 76 is dimensioned to receive and to allow rotation therein of the lug 62, with the recess 78 receiving and permitting rotation therein of the neck 64. An arcuate shaped protrusion 80 having a forward face 82 extends outwardly from rear surface 74. The length of protrusion 80 is the same as the length of the half-round portion, with the diameter of the protrusion 80 being equal to that of the shaft 60. A recess 84 in the overall shape of protrusion 80 is molded into the front surface 72 and is in registry with the position of the protrusion 80 on rear surface 74.

The button 70 is mounted on the shaft 60 by inserting the front face of the lug end portion 62 into the recess 78 and pushing the shaft 60 forwardly until the front face of lug end portion 62 engages the rear wall of the cavity 76. The passageway 66 allows the two halves of the half-round portion on shaft 60 to be squeezed together and assume a smaller diameter as the shaft 60 is inserted within the button 70. When the lug end portion 62 is properly seated within the cavity 76, the two halves of the half-round portion then spread apart and assume their normal orientation.

Pliable means are provided on the opposed faces of the elements 14, 16 so as to conform to the geometry of the trigger and the trigger guard, if appropriate, of the particular firearm to help prevent the device 10 from being pulled free of the firearm. As shown, the elements 14, 16 have a sponge-like cushion 86 on their opposed faces which also helps to prevent marring of the surfaces of the trigger 20 and trigger housing 22. However, other pliable means, such as brushes, soft plastic, rubber or other appropriate materials, may be utilized in lieu of the cushions 86.

Although no shown, means could be provided on the device 10 to signal or actuate an alarm when there is unauthorized movement of the firearm 18. Further, means could also be provided in connection with such an alarm means to activate and de-activate the alarm.

OPERATION

Figure 2:
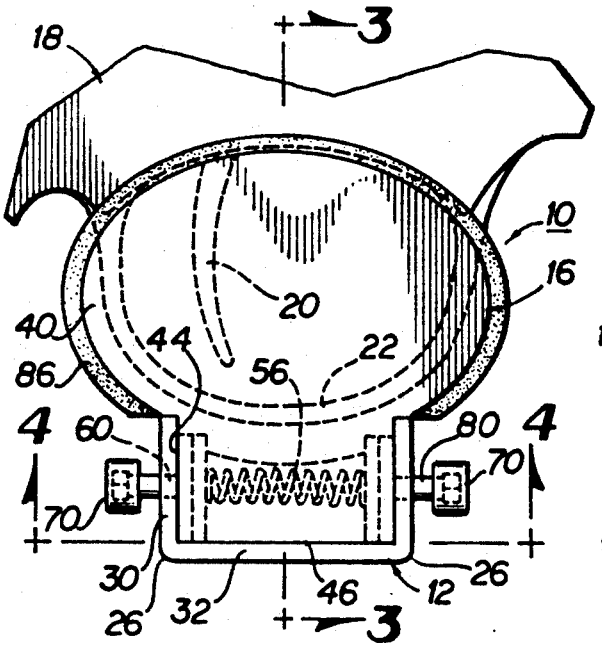
FIG. 2 is a side elongated view of the device in its operative position on a fragmented trigger portion of a firearm.
Figure 3:
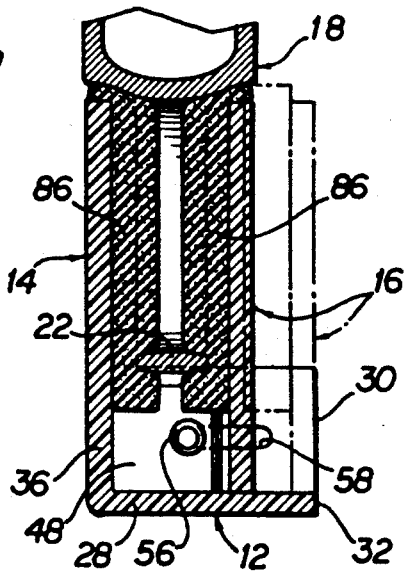
FIG. 3 is a section of the device taken along lines 3—3 in FIG. 2.
Figure 6:
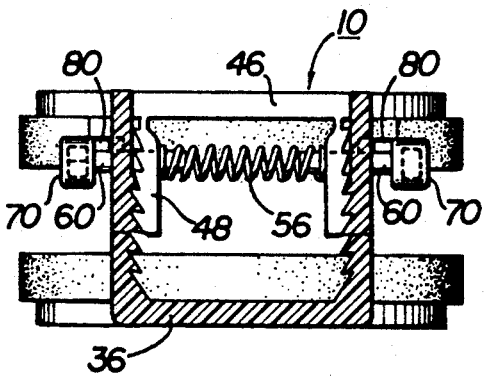
FIG. 6 is a section view similar to FIG. 4 showing the device in its inoperative position.

FIG. 6 shows the invention 10 in its operative mode with the elements 14, 16 being disposed at their farthest distance away from each other. That distance is controlled by the top of the opening 58 limiting the upward movement of the shaft 60. The device 10 is positioned, as shown in FIG. 2, so that the trigger housing 22 and trigger 20 are received between the elements 14, 16.

The buttons 70 are rotated so that the recesses 84, and thus the protrusions 80, are aligned with the face 68 on shaft 60. When that occurs, the faces 82 on the protrusions 80 are in juxtaposition to the faces 68 on shafts 60. If the faces 82 are not in proper alignment with faces 68, the faces 82 will only engage the exterior surfaces of the side walls 24 instead of passing through the openings 58 when the buttons 70 are pressed inwardly, thereby preventing further forward movement of the protrusions 80. Therefore, without the alignment, the serrations 52, 54 will not become disengaged from each other and the second element 16 cannot be moved.

Figure 5:
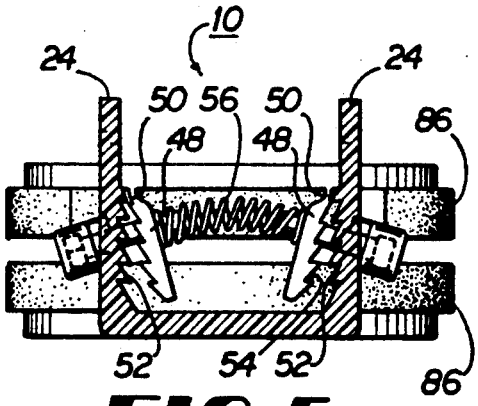
FIG. 5 is a section view of the device similar to FIG. 4 showing the disengagement of the securing means.

When alignment does occur, the buttons 70 are then pressed inwardly through openings 58 which pushes the shafts 60 towards the center of the frame 12. That causes the legs 48 to flex about hinges 50 against the tension of the spring 56, as seen in FIG. 5, thereby allowing the serrations 52, 54 to become disengaged from each other.

Figure 4:
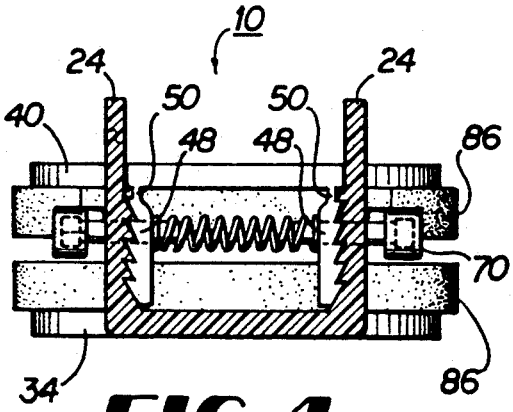
FIG. 4 is a section of the device taken along lines 4—4 in FIG. 2.

Still pressing inwardly on the buttons 70, the user then slides or moves the second element 6 downwardly within the frame 12 until the cushion 86 and then the forward portion 40 comes into contact with the trigger housing 22 and trigger 20. When further downward movement of the second element 16 is prevented, the user releases pressure on the buttons 70. The spring 56 then pushes the legs 48 outwardly about the hinge 50 so that the serrations 54 are moved again into engagement with the serrations 52 on the side walls 24, as seen in FIG. 4. The device 10 is then securely clamped onto the firearm 18. In that position, the faces 82 on the protrusions 80 are once again located exteriorly of the openings 58. The user then rotates the buttons 70 so that the protrusions 80 are no longer in registry with their respective openings 58.

Thus, it can be seen that some degree of visual and manual dexterity is needed on the part of the user to operate the device 10. As a result, a child will be frustrated in his or her efforts to remove the device 10 from the firearm 18, thus preventing unauthorized access thereto.

It is understood that any structure for the clamping device will suffice that would place the two elements 14, 16 into opposed relationship. For instance, the second element 16 could be pivotally joined to the frame 12 to rotate about a horizontal axis into and out of its operative position.

What we claim is:

1. A safety device for a firearm having a trigger, comprising:

(a) a frame having side walls with opposed inner surfaces;

(b) a first element on the frame, the first element having a forward portion and a rear;

(c) a second element moveable on the frame; and (d) means for securing the second element on the frame at a selected distance from the first element so as to engage therebetween, and prevent access to, at least the trigger of the firearm, the second element having a forward portion which is complementary in shape, and in opposed relationship to, the forward portion of the first element, a second portion laterally extending from a rear of the forward portion of the second element and a pair of opposed, parallel legs depending from the second portion and having outer surfaces; the securing means comprising first serrations vertically extending along the inner surfaces of the side walls of the frame and second serrations which are complementary in shape to the first serrations and which are extending on the outer surfaces of the legs and means for releasably positioning the second serrations in or out of engagement with the first serrations in order to maintain the second element at the selected distance from the first element, wherein the releasably positioning means comprises the legs being flexibly connected to the second element to move about a horizontal axis, an opening being defined through each of the side walls of the frame and finger engaging means laterally extending from the outer surfaces of the legs through a respective opening so that when the finger engaging means are pressed inwardly, the second serrations on the legs are moved out of engagement with the first serrations to allow the legs to either be moved downwardly between the side walls to secure the first and second elements in engagement with the trigger or moved inwardly along the side walls to release the second element from its overlying relationship with the first element so that the device can be removed from the firearm.

2. A device as claimed in claim 1 wherein the finger engaging means comprises a shaft having a first end, an opposite second end and a longitudinal axis and having a dimension to extend through the opening and having the first end affixed to the leg and the second end location exteriorly of the side walls of the frame and a head member which is at least partially rotatable on the second end of the shaft about the longitudinal axis of the shaft, the head member having thereon a protrusion which extends towards, and is received within, the opening so that when the head member is rotated to allow the protrusion to be in registry with the opening, the head member can be pressed inwardly to disengage the second serrations from the first serrations.

3. A device as claimed in claim 1 wherein the releasably positioning means further comprises a resilient means located between the legs so as to bias the first serrations into engagement with the second serrations.

4. A device as claimed in claim 3 wherein the resilient means is a spring.

5. A device as claimed in claim 1 wherein the first element and the second element on the frame have opposed surfaces and wherein a pliable means is provided on the opposed surfaces.

6. A device as claimed in claim 5 wherein the pliable means is a cushion.

* * * * *